United States Patent [19]

Steiner

[11] 4,345,879

[45] Aug. 24, 1982

[54] HYDRAULIC SWITCH FOR A PUMP

[75] Inventor: Charles W. Steiner, Brooklyn Park, Minn.

[73] Assignee: Simer Pump Company, Minneapolis, Minn.

[21] Appl. No.: 100,896

[22] Filed: Dec. 6, 1979

[51] Int. Cl.[3] ..... F04B 49/04

[52] U.S. Cl. ..... 417/40; 200/81.9 M; 200/84 C; 417/53

[58] Field of Search ..... 417/36, 40, 53, 211.5; 137/387, 429; 200/84 C, 81.9 M, 82 E, 83 L

[56] References Cited

U.S. PATENT DOCUMENTS

| | | | |
|---|---|---|---|
| 2,840,000 | 6/1958 | Gramenzi | 417/40 X |
| 3,316,845 | 5/1967 | Schumann | 417/40 |
| 3,748,066 | 7/1973 | Sully et al. | 417/424 |
| 3,941,073 | 3/1976 | Ridgeway | 417/40 X |
| 3,963,374 | 6/1976 | Sullivan | 417/40 X |
| 4,081,639 | 3/1978 | Tice | 200/84 C |
| 4,118,150 | 10/1978 | Hope et al. | 417/40 |
| 4,186,419 | 1/1980 | Sims | 417/40 X |

OTHER PUBLICATIONS

Gems Technical Bulletins: Series FS-200/400, Flow Switch for Industrial Shower, Series FS-550, Single Station Level Switches, Level Switch in Air Pollution Control Equip.

*Primary Examiner*—Carlton R. Croyle
*Assistant Examiner*—Edward Look
*Attorney, Agent, or Firm*—Merchant, Gould, Smith, Edell, Welter & Schmidt

[57] ABSTRACT

An hydraulic switch (10) and method for controlling the starting and stopping of a pump is disclosed. Switch (10) has an aperture (34) in the base (32) of a reservoir (28). Liquid enters aperture (34) thereby raising float (38) which operates switching mechanism (26) to start pump motor (20). As liquid is pumped passed impeller (22) along flow path A, some of the liquid is forced into conduit (36) leading to reservoir (28). The liquid flowing through conduit (36) keeps reservoir (28) filled. Consequently, float (38) remains in an elevated position keeping switch mechanism (26) on. Float (38) does not descend until liquid ceases to be pumped and stops flowing through conduit (36). Then, as liquid drains from reservoir (28) through aperture (34), float (38) drops thereby causing switching mechanism (26) to switch motor (20) off.

26 Claims, 5 Drawing Figures

HYDRAULIC SWITCH FOR A PUMP

FIELD OF THE INVENTION

This invention relates to a hydraulic switch for a pump and, more particularly, to a switch having a float in communication with a flow path of the pump such that when the float buoyantly rises due to the high level of liquid fluid, the switch closes, and when the float drops due to cessation of liquid fluid flow through the flow path, the switch opens and the pump stops.

BACKGROUND OF THE INVENTION

Automatic switches for pumps which operate by sensing a predetermined value of a particular liquid parameter are known in the prior art. Pressure sensing switches for electric pumps are available in the marketplace. A pressure switch senses a single pressure source and opens or closes a single electrical circuit by means of one snap action electric switch. Pressure difference switches sense a change in relationship between two variable pressures and open or close a single electrical circuit by means of one snap action electrical switch. These types of switches are in fluid contact with a pressure container and in electrical communication with a pump. The pressure sensing element in a pressure switch is a diaphragm, a bourdon tube, a sealed piston, or some similar mechanism.

Float elements which float on liquid fluids have been used in such applications as to indicate the level of a liquid in a container, to open or close valves, and to start electric pumps. In these applications, when the float element rises to a specified level, it communicates that information by electrical or mechanical means to an indicator, valve or switching element where such element acts on the information according to a preprogrammed plan. Although a single float element is useful to initiate valve action or to start an electrical pump, a second sensing mechanism has been required to reverse the valve action or to stop the electrical pump. As a result, control mechanisms using float elements either accomplish a limited function as just described or are part of a quite complex and expensive mechanism.

SUMMARY OF THE INVENTION

The present invention is comprised of a buoyancy controlled switch mechanism which senses a predetermined liquid level and controls the starting of a pump when the predetermined liquid level is attained and further controls the running of the pump while the liquid is at or above the predetermined liquid level, the buoyancy sensing mechanism being in combination with a reservoir for holding the liquid to be sensed including a means for maintaining the predetermined liquid level while the pump continues to pump liquid.

In a preferred embodiment, the hydraulic switch is an assembly which is bracketed to the outside of a pump housing. The hydraulic switch is in fluid communication with the flow path of the pump and in electrical communication with the motor which drives the pump. The sensing mechanism is a ring-shaped float with permanent magnets embedded in its walls. The float travels along a stem which has an internal snap-action switch which actuates when the float rises and brings the magnets therein to an appropriate vertical relationship relative to the switching mechanism. A plastic housing comprised of a body and a base surrounds the sensing mechanism. The body is a cylindrical, plastic unit with a top. An inlet tube extends from the upper portion of the body for attachment to a corresponding opening in the pump housing. Brackets extend from the lower portion of the body for attachment to the pump housing. An internal concentric baffle, spaced apart from the body wall, extends downwardly from the top of the body so as to provide a guide for the float and to deflect liquid from the inlet tube downward away from direct impact with the float. Air vents are provided in the top of the body at locations above the float and above the space between the wall of the body and the baffle. The stem of the sensing mechanism is axially located and potted with a waterproof compound in the top of the body, thus allowing electrical wiring to extend exteriorly of the body. The base is screwed to the body to complete the necessary enclosing reservoir about the sensing mechanism. An opening is provided in the base plate to allow rising water to enter the hydraulic switch and actuate it when the float has buoyantly risen to the appropriate vertical level. The base opening also serves as an outlet for water entering the body through the inlet tube during pumping operation.

It is particularly advantageous that the disclosed hydraulic switch not only provides for starting a pump when the float buoyantly rises to an appropriate predetermined liquid level, but also provides for stopping the pump when the pump stops pumping liquid since at that time all liquid drains from the reservoir enclosure, the float drops and the switching mechanism opens electrically causing the pump motor to stop.

Also, the hydraulic switch is a simple, and consequently inexpensive, device. In the preferred embodiment, the body having an upright wall, a top wall, a baffle, an inlet conduit, and a bracket is formed as an integral unit from a plastic material. The base is formed from a similar plastic material. The stem and float mechanism is commercially available.

For a better understanding of the hydraulic switch, its advantages, and objects attained by its use, refer to the drawings which form a further part of this disclosure, and to the accompanying descriptive matter in which there are illustrated and described preferred and other embodiments of the invention.

DETAILED DESCRIPTION OF THE INVENTION

Figure 1:
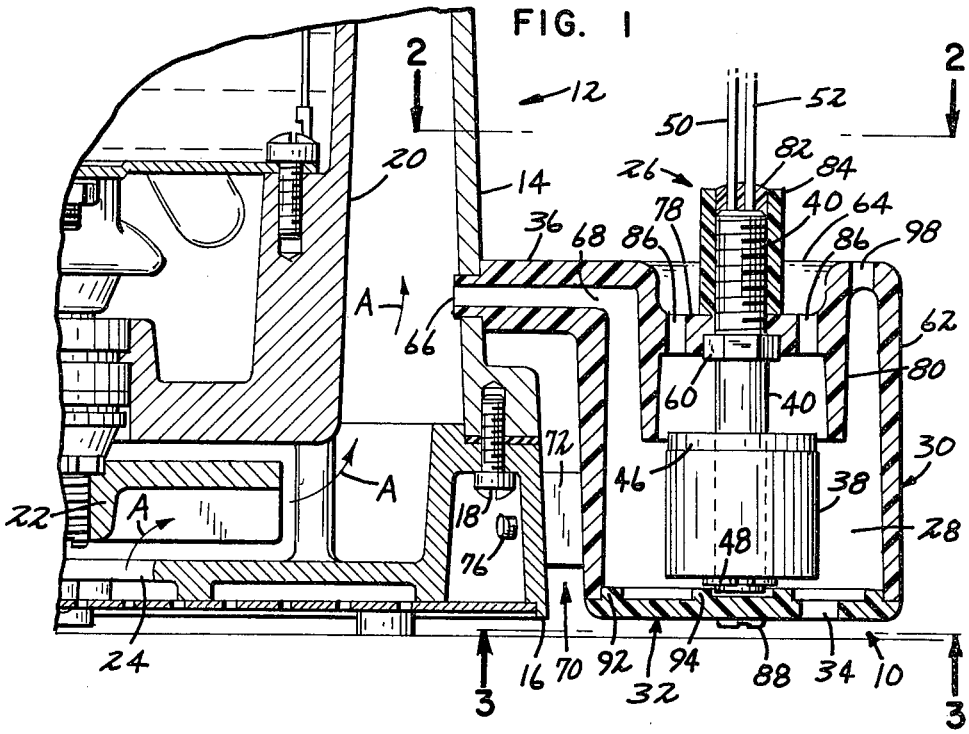
FIG. 1 is a side elevation of the invention, partially in section, attached to a partially shown pump assembly, also in side elevation and section.

Referring to the drawings in detail, wherein like numerals indicate like elements, there is illustrated in FIG. 1 an hydraulic switch designated generally as 10 attached to a pump assembly designated generally as 12. Pump assembly 12 is comprised of a housing 14 and a base 16. Housing 14 and base 16 are fastened together with screws 18. Pump motor 20 is seated in base 16. An impeller 22 is attached to the drive shaft of motor 20. With motor 20 operating, liquid is drawn through opening 24 in base 16 by impeller 22 and is forced along a path between the wall of housing 14 and the wall of motor 20 to an outlet opening, not shown, from pump assembly 12. The flow path of the liquid through the pump assembly 12 is illustrated by arrows A. The pump assembly 12 is described in greater detail in U.S. Pat. No. 3,748,066, herein incorporated by reference. It is to be understood, however, that the invention may be used very advantageously with other types of pump assemblies.

Hydraulic switch 10 is comprised of a sensing and switching mechanism 26 and a reservoir 28 comprised of body 30 and base 32. Liquid initially enters reservoir 28 through aperture 34 in base 32. Liquid is maintained in reservoir 28 by flowing from the flow path of pump assembly 12 into reservoir 28 through an inlet conduit 26 which provides fluid communication between pump assembly 12 and reservoir 28. Pump assembly 12 is turned "on" when liquid entering through aperture 34 accumulates to a predetermined level within reservoir 28. At that time sensing and switching mechanism 26 senses the liquid and switches motor 20 to the "on" position. As long as liquid continues to be pumped, liquid will pass through inlet tube 36 into reservoir 28 and out aperture 34, thereby maintaining the predetermined liquid level within reservoir 28 and keeping motor 20 running. When the pumping of liquid ceases, the liquid drains through aperture 34 and the liquid level within reservoir 28 falls below the predetermined level which is sensed by sensing and switching mechanism 26 causing mechanism 26 to electrically switch motor 20 to the "off" position.

It is to be understood that body 30 and base 32 as reservoir 28, inlet conduit 36 as an inlet tube and aperture 34 as a fluid exhaust are but one example of a reservoir, a mechanism for communicating liquid between pump assembly 12 and hydraulic switch 10 and a mechanism for maintaining a predetermined liquid level within the reservoir, respectively. Alternatively, for example, a reservoir may have a base with integral sides rising therefrom. Liquid could be communicated to the reservoir by dropping through an opening in a pump outlet conduit. The liquid level in the reservoir could be maintained by providing only a small outlet tube in the reservoir wall somewhere below the location of the sensing and switching mechanism 26. The sensing and switching mechanism 26 would be located at least partially in the reservoir. The pump would start when liquid had risen to an appropriate level within the reservoir by entering through the reservoir outlet tube. The liquid level would be maintained by the continuous stream from the pump outlet conduit. When the pump stopped pumping liquid, the liquid in the reservoir would drain through the reservoir's outlet tube and the sensing and switching mechanism 26 would cause the pump to stop running.

Figure 4:
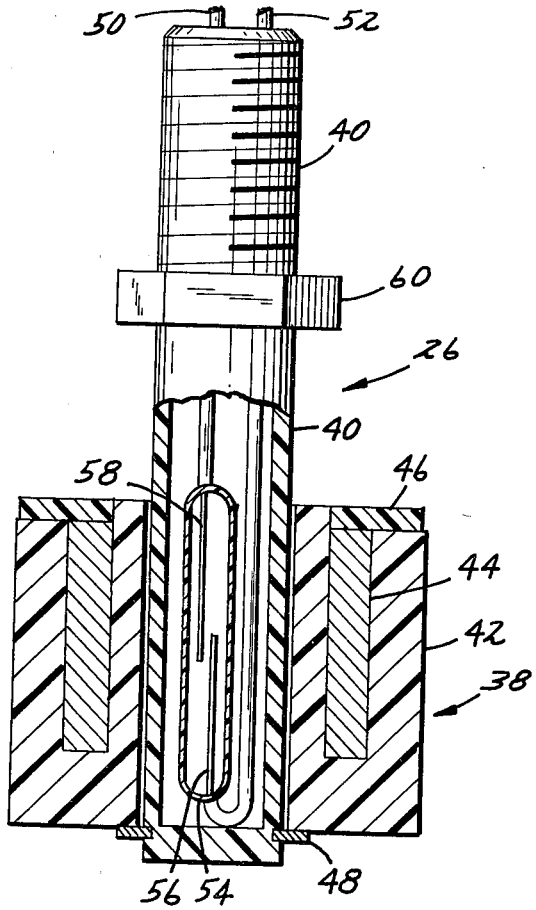
FIG. 4 is a side elevational view, partially in section, of the sensing and switch mechanism.

In the preferred embodiment, sensing and switching mechanism 26, shown in partial cross-section in FIG. 4, includes float 38 and stem 40. Float 38 is generally cylindrical having an axially, hollow center. Float 38 is comprised of a lower member 42 having a plurality of permanent bar magnets inserted into appropriately-sized spaces and held in place by adhesively attached top 46. Top 46 is a flat ring for covering magnets 44 and having inner and outer diameters such that when top 46 is attached, float 38 has a flat top and sides extending at a 90° angle downward therefrom. Lower member 42 and top 46 are made from a material having a specific gravity much greater than 1.0 so that float 38 will exhibit considerable positive buoyancy in liquids of various density.

Stem 40 is generally tubular in shape with an outer diameter slightly smaller than the inner diameter of float 38. Wire 50 and wire 52 extend through the top of stem 40 into its interior. Both wire 50 and wire 52 are insulated except for a short portion at the ends. Wire 52 is longer than wire 50 and has a semicircular bend near its end 56 so that when the insulation-free ends are held by insulator 54 in a parallel, spaced-apart relationship, end 58 of wire 50 points downward while end 56 of wire 52 points upward. Wires 50 and 52 are made from a conductive material sufficiently flexible to allow magnets 44 to magnetically deflect ends 56 and 58 into contact with each other when float 38 rises to an appropriate vertical level along stem 40. Wires 50 and 52 are held in place by the top, not shown, of stem 40. The top of stem 40 is adhesively attached to the inside walls of stem 40.

The upper portion of the outer wall of stem 40 is threaded. A hexagonal nut is molded as a part of stem 40 at the lower end of the threaded portion. Clip 48 fits within a cylindrical slot in the solid bottom of stem 40. Float 38 is free to move between clip 48 and nut 60, a distance approximately one and one half times the height of float 38. Magnets 44 and wire ends 56 and 58 are vertically positioned relative to one another such that ends 56 and 58 are not in contact with each other, that is, the switch is "open", when float 38 rests on clip 48, and ends 56 and 58 are in contact with each other, that is, the switch is "closed", when float 38 is in contact with nut 60.

A suitable sensing and switching mechanism 26 is commercially available from the Gems Division of De Laval Turbine Corporation, Farmingham, Conn. 06032 as model LS-3, part number 47,979.

Figure 2:
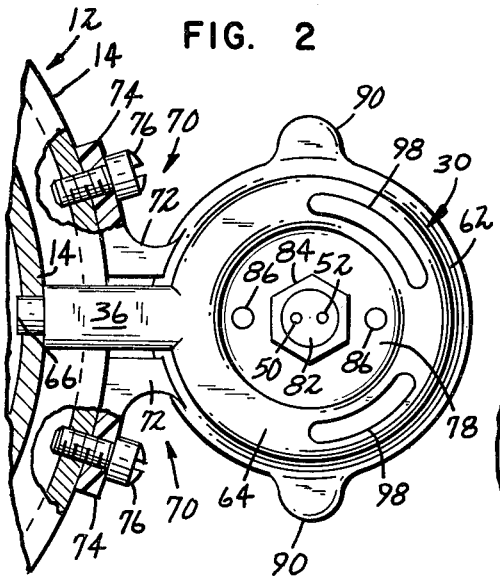
FIG. 2 is a top view of the invention, taken generally along line 2—2 of FIG. 1, with cutaway views showing the screws attaching the invention to the pump housing.
Figure 3:
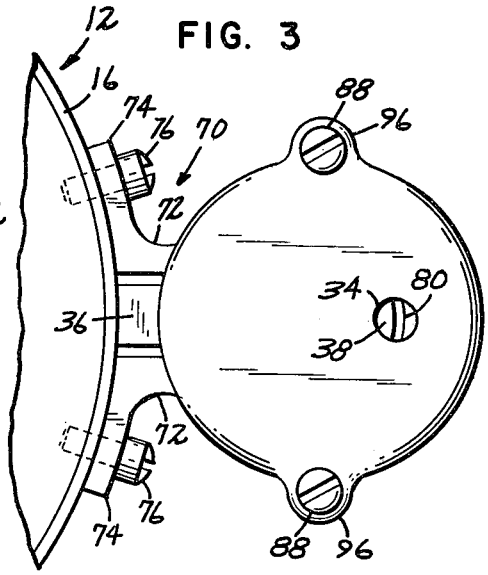
FIG. 3 is a bottom view of the invention, taken generally along line 3—3 of FIG. 1.

As previously indicated, in the preferred embodiment, body 30 and base 32 form an enclosed reservoir about sensing and switching mechanism 26. Body 30 is hollow, having a cylindrical wall 62, an outer top 64, and an inner top 78. The inlet conduit 36 extends outward from the upper portion of wall 62 so that the top of conduit 36 is level with outer body top 64. Conduit 36 has a substantially square outer contour with rounded edges. At the inlet end 66 of conduit 36, that is, the end farthest from wall 62, conduit 36 abruptly changes from a substantially square outer contour to a cylindrical contour of smaller diameter than the length of a conduit side. A hollow axial bore extends from inlet end 66 to the opposite or outlet end 68 at the interior of body 30. The length of the cylindrical contour portion of inlet conduit 36 is approximately the same as the thickness of pump housing 14. Along the lower portion of wall 62 two bracket extensions 70 project from all 62. Each bracket extension 70 is on an opposite side of the vertical plane passing through the center of inlet conduit 36 and is equally spaced from that plane. As shown in FIGS. 2 and 3, each bracket 70 has a leg portion 72 extending from wall 62 in a direction parallel with inlet conduit 36 and a mating surface portion 74 extending at approximately right angles from the leg portion 72 and away from inlet conduit 36. The mating surface portion 74 of each bracket 70 has a side away from body 30 which is appropriately contoured to mate with the outer surface of base 16 of pump assembly 12. The thickness of brackets 70 is sufficient to provide the required structural strength to hold hydraulic switch 10 relative to pump assembly 12. The vertical length of brackets 70 is approximately three or four times the diameter of a hole centered in the mating surface portion 74 of the brackets 70. Screws 76 pass through the indicated holes in brackets 70 and thread into corresponding holes in base 16 of pump assembly 12, thereby attaching hydraulic switch 10 to the pump assembly 12. The distance which brackets 70 extend from wall 62 of body 30 is sufficient to hold brackets 70 a slight distance away from pump assembly 12. The length of inlet conduit 36 corresponds with the distance which brackets 70 extend from body 30 in a way which allows both conduit 36 and brackets 70 to appropriately contact pump assembly 12 while at the same time holding the axis of body 30 vertical. The mating hold in housing 14 for the cylindrical portion of inlet conduit 36 and the mating holes in base 16 for screws 76 are located so that the bottom of base 32 of hydraulic switch 10 and the bottom of base 16 of pump assembly 12 are in the same horizontal plane. With the body 30 secured to the pump assembly 12 by brackets 70 and screws 76, the conduit 36 is received within the hole through the housing 14 in a fluid type manner to direct a portion of the liquid being pumped through the pump assembly 12 to the reservoir 28.

A cylindrical baffle 80 internally concentric to and spaced apart from cylindrical wall 62 extends from the outer top 64 of body 30. The wall thickness of the baffle 80 is approximately the same as the wall thickness of wall 62. The internal diameter of baffle 80 is slightly greater than the diameter of float 38. Outer top 64 covers the ring-shaped space between wall 62 and baffle 80. Outer top 64 is rounded along its outer surface at its outer and inner diameters. Inner top 78 is located in the space defined by the inner diameter of baffle 80. Inner top 78 is depressed from top 64. An axial bore passes through inner top 78 having a slightly larger diameter than the diameter of stem 40 of sensing and switching mechanism 26. A cavity the same shape as nut 60 on stem 40 is located on the underside of inner top 78 centered on the bore axis. With sensing and switching mechanism 26 installed in body 30 so nut 60 fits into the corresponding cavity in inner top 78, baffle 80 extends downwardly from top 64 to a point just below the top of float 38 when float 38 is resting on clip 48. With this configuration, baffle 80 not only deflects high velocity fluid coming into body 30 through inlet conduit 36, but also guides float 38 as it positions itself vertically along stem 40. Sensing and switching mechanism 26 is fixed in place with a standard waterproof molding compound 82 poured into nest sleeve 84 and over and around the upper portion of stem 40. Two circular air vents 86 (see FIG. 2) are located in inner top 78 to provide for the expulsion of air as float 38 rises toward inner top 78 within baffle 80. Two elongated air vents 98 are spaced apart in outer top 64 in the side opposite inlet conduit 36. Air vents 98 provide for the expulsion of air in the space between wall 62 and baffle 80. Air vents 98 have the same width as the distance separating wall 62 from the baffle 80 and a length approximately equivalent to one sixth the circumference of the diameter midway between the outer diameter of baffle 80 and the inner diameter of wall 62.

Along the lower portion of wall 62 at 90° from inlet conduit 36, there are protrusions 90 of sufficient girth and length to accept the shank portion of screws 88 which fasten base 32 to body 30. Base 32 is a circular flat plate having on its upper side a raised cylindrical ring 92 with an outer diameter to match the inner diameter of wall 62 of body 30 and a second raised cylindrical ring 94 at its center having an inner diameter slightly larger than the diameter of stem 40. The outer raised ring 92 serves as a guide when mating base 32 to body 30. The inner raised ring 94 of base 32 serves as a retainer for stem 40. Two ear portions 96, matching the contour of protrusions 90, on opposite sides of base 32 have holes appropriately located and sized for allowing the shank portion of screws 88 to pass through and fasten base 32 to body 30. Base 32 has an opening or aperture 34 on the side directly opposite inlet conduit 36. The diameter of aperture 34 is sufficient to allow an equivalent or lesser quantity of water to exit from reservoir 28 as is allowed to enter reservoir 28 through inlet conduit 36.

Figure 5:
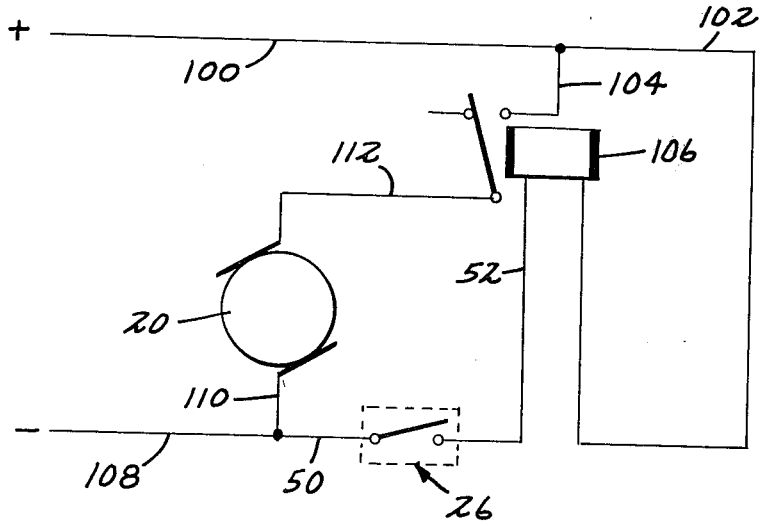
FIG. 5 is an electrical schematic of the hydraulic switch in combination with a pump and power source.

A schematic diagram for electrically connecting pump motor 20 and hydraulic switch 10 to a power source is shown in FIG. 5. The positive side of a power source is connected by line 100 at a common point to lines 102 and 104. The other end of line 102 is connected to a coil terminal of relay 106. The other end of line 104 is connected to a switch terminal of relay 106. Line 52 of sensing and switching mechanism 26 is connected to the other coil terminal of relay 106. Line 50 of sensing and switching terminal 26 is connected to a common point with lines 108 and 110, with line 108 leading to the negative side of the power source. The other end of line 110 connects to one of the two terminals on pump motor 20. The other terminal of pump motor 20 is connected via line 112 to the second switch terminal of relay 106. FIG. 5 shows the switch portion of sensing and switching mechanism 26 and the switch portion of relay 106 both open, which is the non-operational configuration.

In operation, pump assembly 12 and hydraulic switch 10 are located in a containing enclosure in which liquid can accumulate. When liquid rises in the containing enclosure to a level which causes sensing and switching mechanism 26 to switch pump assembly 12 to the "on" position, pump assembly 12 pumps all the liquid from the containing enclosure, at which time hydraulic switch 10 switches pump assembly 12 to the "off" position.

More particularly, rising liquid contacts base 16 of pump enclosure 12 and base 32 of hydraulic switch 10 at the same time. As the liquid continues to rise, it passes through opening 34 and begins to accumulate in reservoir 28. If liquid within the enclosure were to rise more rapidly than opening 34 could accomodate, the liquid would rise along the outside of body 30. Under such a condition, the air vents 98 could serve as secondary liquid inlets. Float 38 floats on the accumulating liquid and rises along stem 40 forcing air out air vents 86. Air is also forced out air vents 98. When float 38 has risen vertically to a position which allows permanent magnets 44 to deflect wire ends 56 and 58 into contact with each other, the switch portion of sensing and switching mechanism 26 is "closed". This causes the coil of relay 106 to be energized, which in turn causes the switch portion of relay 106 to close thus placing the power source across the two terminals of pump motor 20 and causing it to operate. Liquid is then drawn through opening 24 in the base 16 of pump assembly 12 and forced by impeller 22 upward between the outer wall of pump motor 20 and the inner wall of housing 14 to an exhaust port, not shown. Some of the liquid is forced into the inlet end 66 of inlet conduit 36 of hydraulic switch 10. The liquid impacts baffle 80 and is deflected downward toward base 32. The same amount or a lesser amount of liquid exhausts from aperture 34 in base 32. Thus, as long as pump assembly 12 continues to pump liquid, reservoir 28 continues to hold liquid and, consequently, the liquid holds float 38 in a position which keeps the switch portion of sensing and switching mechanism 26 in the "closed" position. If aperture 34 is too large, more liquid will exit from reservoir 28 than will enter the reservoir 28 and float 38 will fall causing pump motor 20 to prematurely stop. If aperture 34 is too small, less liquid will exit from reservoir 28 than will enter the reservoir 28 with the consequence that excess liquid will harmlessly exhaust through air vents 98. When the enclosing container is emptied of liquid so that pump assembly 12 begins to pump air, the liquid in reservoir 28 empties through aperture 34 causing float 38 to fall in turn causing the switching portion of sensing and switching mechanism 26 to open, the switching portion of relay 106 to open, and pump motor 20 to stop.

Numerous characteristics and advantages of the invention have been set forth in the foregoing description, together with details of the structure and function of the invention. The disclosure, however, is illustrative only, and it is therefore to be understood that changes may be made in detail, especially in matters of shape, size, and arrangement of parts, within the principal of the invention, to the full extent extended by the broad general meaning of the terms in which the appended claims are expressed.

What is claimed is:

1. A hydraulic switch for controlling the operation of a pump, comprising:

means for buoyantly sensing a predetermined liquid level;

means for controlling the pump while said sensing means senses liquid at or above said liquid level;

reservoir means for holding liquid to be sensed by said sensing means;

means for communicating liquid from the discharge conduit of said pump to said reservoir means; and means for draining from said reservoir means said liquid flowing into said reservoir means.

2. A hydraulic switch in accordance with claim 1 wherein said switch includes means for externally bracketing said switch to a housing of the pump whereby said hydraulic switch is an assembly for external attachment to the pump housing.

3. A hydraulic switch for keeping an electric pump operating only as long as said pump continues to pump liquid fluid through a discharge conduit, said switch comprising:

electrical means for controlling an electrical circuit for energizing and deenergizing said electric pump, said electrical means including an electrical switch;

reservoir means for holding liquid fluid therein, said reservoir means including a bottom with a wall rising from the perimeter thereof, the wall having an upper portion and a lower portion;

first means for communicating liquid fluid between said pump discharge conduit and said reservoir means;

second means for communicating liquid fluid between said reservoir means and a location external to said pump and said reservoir means; and means for buoyantly sensing an accumulation of liquid fluid within said reservoir means, said sensing keeping said electrical switch in a configuration for energizing said electric pump as long as approximately the same amount of liquid fluid enters one of said first and second communicating means as leaves the other of said first and second communicating means.

4. A hydraulic switch in accordance with claim 3 further comprising means for externally bracketing said reservoir means to a housing of the pump and wherein said first communicating means includes a straight inlet tube having an outlet end in communication with said reservoir means and connected to the upper portion of the wall of said reservoir means, whereby said hydraulic switch is an assembly for external attachment to the pump housing.

5. A hydraulic switch in accordance with claims 3 or 4 wherein said second communicating means includes an opening in a bottom portion of said reservoir means.

6. A hydraulic switch in accordance with claim 4 wherein said reservoir means further includes a top and a baffle, said baffle spaced apart from the outlet end of the inlet tube and located between the wall of the reservoir means and said sensing means, said baffle extending from the top of the reservoir means downward, whereby said baffle blocks said sensing means from the impact of fluid exiting from the outlet end of the inlet tube.

7. A hydraulic switch in accordance with claim 6 wherein said reservoir means includes a vent opening in the top at a location vertically above the space between said baffle and said wall of said reservoir means whereby as liquid rises in said reservoir, air can exhaust through the vent opening, rather than compress, thus allowing said sensing means to sense the rising liquid.

8. A hydraulic switch in accordance with claim 7 wherein the top, the wall, the baffle, and the inlet tube are formed as an integral unit.

9. A hydraulic switch in accordance with claim 8 wherein said base is formed discrete from the wall and is removably attached thereto.

10. A hydraulic switch in accordance with claim 6 wherein said sensing means includes a float disposed for motion in said reservoir means and a stem extending into said reservoir means to guide the motion of said float, said stem containing a magnetically actuable switch to control the running of the pump, and said float containing a permanent magnet to activate said magnetically actuable switch when the liquid in said reservoir is at or above said given accumulation.

11. A hydraulic switch in accordance with claim 10 wherein said baffle extends downwardly from said top in a generally encircling relationship to said float and said stem.

12. A hydraulic switch in accordance with claim 11 wherein a vent opening is formed in said top at a location vertically above said float.

13. A hydraulic switch for starting and keeping an electric pump running only as long as the pump continues to pump a liquid fluid, the pump being enclosed in a housing, comprising:

a baseplate with an opening for the passage of liquid fluid;

a hollow body, attached to said baseplate to form an enclosure, said body having a cylindrical wall, a top with a vent opening, an inlet tube connected to the wall proximate the top for providing fluid communication between said hollow body and said pump housing, a cylindrical baffle internally concentric to and spaced apart from the cylindrical wall extending from the top of said body approximately halfway to said baseplate for deflecting downward the liquid fluid entering the body through the inlet tube, and means on the wall of said body for bracketing said body to the pump housing;

means for buoyantly sensing a specified accumulation of liquid fluid within the enclosure formed by said body and said baseplate, for electrically starting said pump when the liquid fluid accumulation is sensed and for electrically keeping said pump running only as long as the liquid fluid accumulation is present; and means for attaching said sensing means within the enclosure formed by said body and said baseplate to include means for passing electrical wiring from said sensing means within the enclosure to the outside of the enclosure.

14. A hydraulic switch in accordance with claim 13 wherein said sensing means includes a float disposed for motion in said enclosure and a stem extending into said enclosure to guide the motion of said float, said stem containing a magnetically actuable switch to control the running of the pump, and said float containing a permanent magnet to activate said magnetically actuable switch when the liquid in said enclosure is at or above the specified accumulation.

15. A hydraulic switch in accordance with claim 14 wherein said baffle extends downwardly from said top in a generally encircling relationship to said float and said stem.

16. A hydraulic switch in accordance with claim 15 wherein a vent opening is formed in said top at a location vertically above said float.

17. The method of operating an electrical sump pump, said pump having a housing with a flow path running from an intake through said pump to an outlet, said method comprising the steps of:

sensing the presence of liquid fluid within a reservoir;

switching said pump on when a predetermined accumulation of liquid fluid in said reservoir is sensed;

communicating continuously some liquid fluid from the flow path of said pump housing to said reservoir, said reservoir allowing liquid fluid to exit at approximately the same rate as the liquid fluid enters once the reservoir has the predetermined accumulation of liquid fluid;

draining said reservoir when said pump continues to operate but pumps no liquid fluid; and switching said pump off when the predetermined accumulation of liquid fluid in said reservoir is no longer sensed.

18. A hydraulic switch for controlling the operation of a pump, comprising:

means for buoyantly sensing a predetermined liquid level;

means for controlling the pump while said sensing means senses liquid at or above said liquid level;

reservoir means for holding liquid to be sensed by said sensing means, said reservoir means having a base and an upright encircling wall extending therefrom to define a liquid reservoir, at least a portion of said sensing means being disposed in said reservoir, said reservoir means including means for maintaining at least the predetermined liquid level in said reservoir means while the pump continues to pump liquid, said maintaining means including an inlet conduit having an inlet end in communication with a flow path downstream from the pump and an outlet end in communication with said reservoir.

19. A hydraulic switch in accordance with claim 18 wherein said body includes a top wall and a baffle, said baffle being spaced apart from the outlet end of the inlet conduit and located between the upright wall of the body and said sensing means, said baffle extending from the top of the body to a point below the outlet end of the inlet conduit, whereby said baffle protects said sensing means from the impact of liquid exiting from the outlet end of the inlet conduit.

20. A hydraulic switch in accordance with claim 19 wherein said body includes a vent opening in the top of said body whereby as liquid rises in said reservoir, air can exhaust through the vent opening, rather than compress, thus allowing said sensing means to sense the rising liquid.

21. A hydraulic switch in accordance with claim 20 wherein the top wall, the upright wall, the baffle, and the inlet conduit are formed as an integral unit.

22. A hydraulic switch in accordance with claim 21 wherein said base is formed discrete from the upright wall and is removably attached thereto.

23. A hydraulic switch in accordance with claim 19 wherein said sensing means includes a float disposed for motion in said reservoir and a stem extending into said reservoir to guide the motion of said float, said stem containing a magnetically actuable switch to control the running of the pump, and said float containing a permanent magnet to activate said magnetically actuable switch when the liquid in said reservoir is at or above said predetermined level.

24. A hydraulic switch in accordance with claim 23 wherein said baffle extends downwardly from said top wall in a generally encircling relationship to said float and said stem.

25. A hydraulic switch in accordance with claim 24 wherein at least one vent opening is formed in said top wall at a location vertically above said float.

26. A hydraulic switch in accordance with claim 18 wherein said inlet conduit is straight.

* * * * *

UNITED STATES PATENT AND TRADEMARK OFFICE

CERTIFICATE OF CORRECTION

PATENT NO. : 4,345,879

DATED : August 24, 1982

INVENTOR(S) : Charles W. Steiner

It is certified that error appears in the above—identified patent and that said Letters Patent is hereby corrected as shown below:

Column 1, line 35, after "valve" insert --,--.

Column 3, line 19, delete "26" and insert therefor --36--.

Signed and Sealed this

*Eighteenth* Day of *January 1983*

[SEAL]

*Attest:*

GERALD J. MOSSINGHOFF

*Attesting Officer*

*Commissioner of Patents and Trademarks*